United States Patent [19]

Mills

[11] 3,942,196

[45] Mar. 9, 1976

[54] DISPOSABLE BEDPAN INSERT

[76] Inventor: Kenneth Wilson Mills, 11 Redcar Road, Smithills Dean, Bolton, Lancashire, England

[22] Filed: Feb. 4, 1975

[21] Appl. No.: 547,019

Related U.S. Application Data

[63] Continuation of Ser. No. 400,508, Sept. 25, 1973, abandoned.

[30] Foreign Application Priority Data

Oct. 5, 1972 United Kingdom ..... 45863/72

[52] U.S. Cl. ..... 4/112; 4/110; 4/113

[51] Int. Cl.[2] ..... A61G 9/00

[58] Field of Search ..... 4/110, 112, 113, 138, 142, 4/141

[56] References Cited

UNITED STATES PATENTS

| | | | |
|---|---|---|---|
| 1,388,155 | 8/1921 | Abraham | 4/112 |
| 3,160,893 | 12/1964 | Steel et al. | 4/112 |
| 3,246,344 | 4/1966 | Saulson | 4/112 |
| 3,597,771 | 8/1971 | Rickmeier, Jr. | 4/112 |

FOREIGN PATENTS OR APPLICATIONS

| | | | |
|---|---|---|---|
| 1,299,786 | 7/1961 | France | 4/112 |
| 898,903 | 6/1962 | United Kingdom | 4/112 |

*Primary Examiner*—Henry K. Artis
*Attorney, Agent, or Firm*—Ulle C. Linton

[57] ABSTRACT

The invention provides a disposable insert for a bedpan or commode, said insert having a seat-portion for fitting over the peripheral area of the supporting member, and within said seat-portion an aperture forming an opening into the receptacle portion of the insert and said seat portion being formed at each side towards its rear with a concavity, and at its rear a central depression said concavities and depression being merged smoothly together and shaped to receive the buttocks and relieve pressure on the posterior bones of a person using the seat.

1 Claim, 8 Drawing Figures

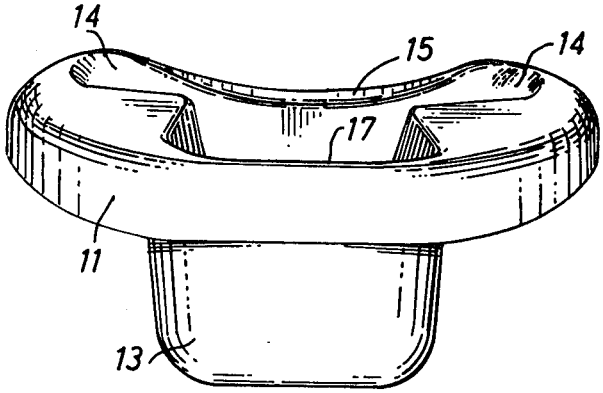
-FIG. 3-
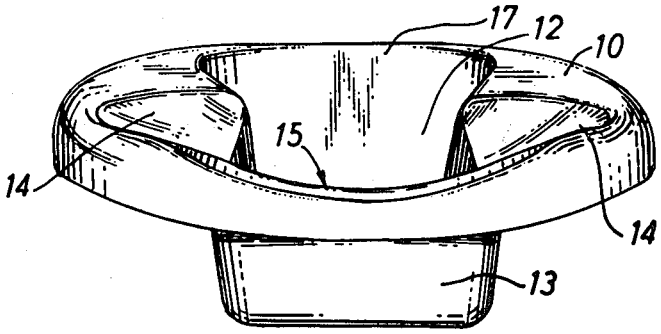
-FIG. 4-

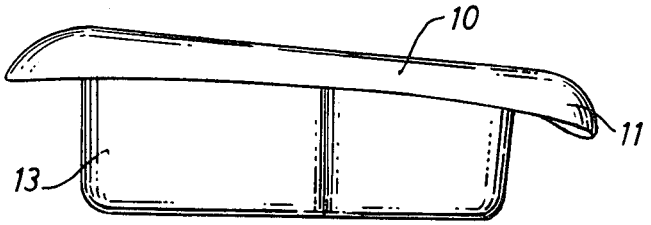
-FIG. 5.-
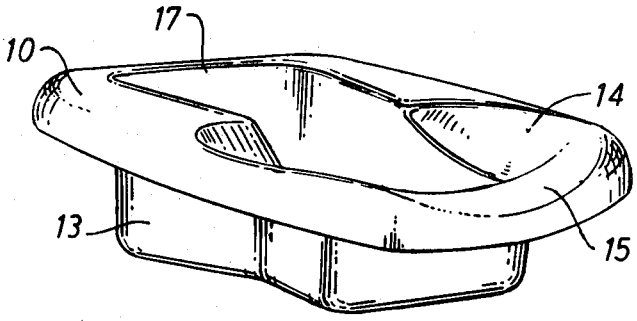
-FIG. 6.-

DISPOSABLE BEDPAN INSERT

This is a continuation of application Ser. No. 400,508 filed Sept. 25, 1973 and now abandoned.

This invention is for improvements in or relating to disposable inserts, for bed-pans, commodes and like sanitary articles.

The primary object of the invention is to provide disposable insert for a bed-pan or commode, having a "seat" which will afford the user much more comfort than has been the case heretofore.

According to the present invention there is provided a disposable insert for a bed-pan or commode, said insert having a seat-portion formed so as to fit over the peripheral area of the supporting member, and within said seat portion an aperture forming an opening into the receptacle portion of the insert, said seat portion being formed at each side towards its rear with a concavity, and at the rear a central depression or concavity, said concavities and depression merging smoothly together and being shaped to receive the buttocks and relieve pressure on the posterior bones of a person using the seat. Said concavities, being so positioned, ensure that the centre of gravity of a user tends to take up a position well within the base of the bed-pan and this helps considerably in preventing loss of balance of a person using same.

In preferred embodiments of the invention the aperture in the seat portion is elongated in a direction from front to rear and is waisted between its ends. Preferably, the waist is a little more towards the rear than the front of the seat. Thus, the aperture has, in plan, somewhat the shape of a figure eight or keyhole. The receptacle portion of the insert may be correspondingly shaped in plan.

One particular embodiment of the invention will now be described, by way of example only, as applied to a disposable bed-pan insert. In the following description reference is made to the accompanying drawings in which:

FIG. 3 is a view from the front,

FIG. 4 is a view from the rear,

FIG. 5 is a side view,

FIG. 6 is a perspective view,

Figure 1:
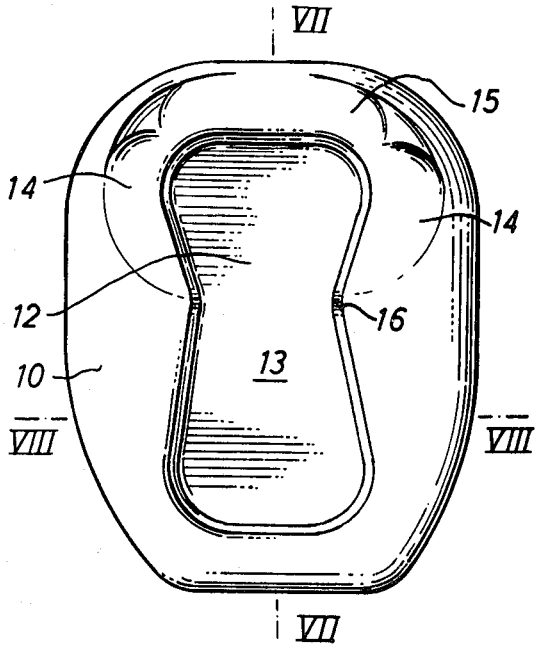
FIG. 1 is a plan view of a bed-pan insert, according to the invention.
Figure 2:
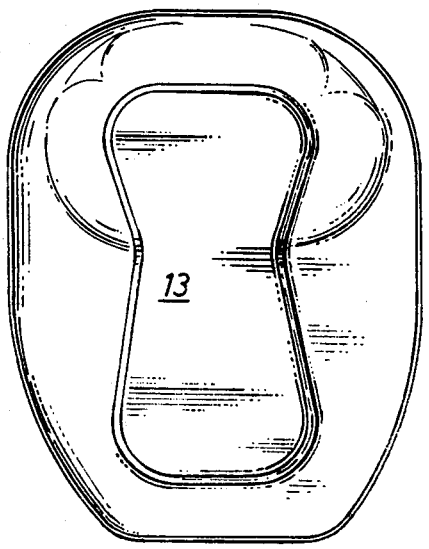
FIG. 2 is an underneath plan view.
Figure 7:
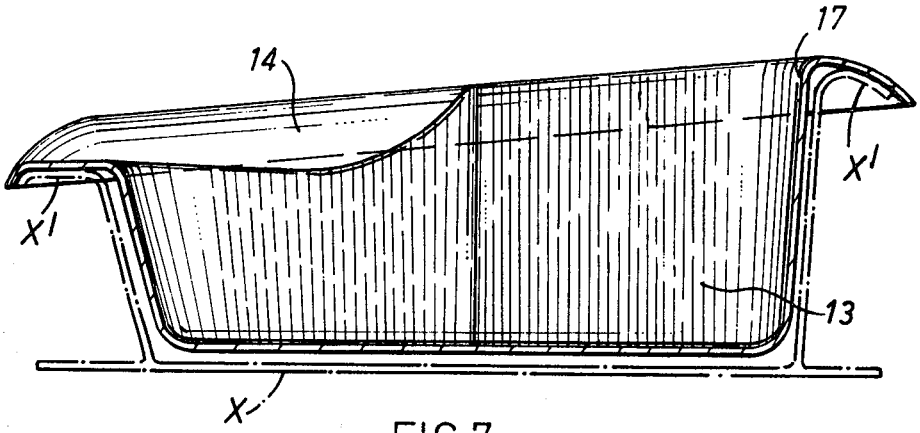
FIG. 7 is a cross-section on the line VII—VII of FIG. 1.
Figure 8:
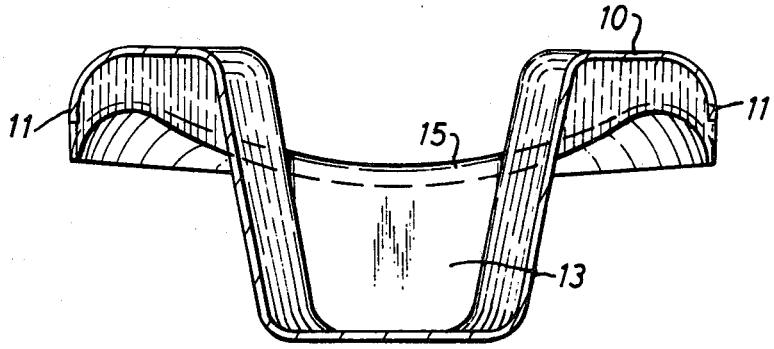
FIG. 8 is a cross-section on the line VIII—VIII of FIG. 1.

The bed-pan insert shown in the drawings is moulded or pressed to shape from, e.g., cellulose pulp. It has a seat portion 10 formed with a downturned peripheral edge 11 which is designed so as to be a free fit over and shroud the upper edge X′ of a rigid bed-pan support X shown in broken lines in FIG. 7.

Within the seat 10 there is an aperture 12 which forms an opening into the receptacle portion 13 of the insert. The receptacle 13 has a slight downward taper and is designed so as to be a free sliding fit in a supporting bed-pan X, and to be nestable with fellow inserts for storage and packing purposes.

Side concavities 14 and a central depression or concavity 15, which merge smoothly together, are provided in the rear area of the seat 10 so as to receive the buttocks, and relieve pressure on the posterior bones, of a person using the bed-pan. The rear central depression or concavity 15, as shown most clearly in FIGS. 3, 4 and 6, will facilitate use of the bed-pan by a lying down patient.

The aperture 12 is elongated in a direction from front to rear and is formed with a waist as indicated at 16.

The front of the seat portion of the insert is somewhat higher than the rear so as to form a splash barrier 17.

It will be noted that the receptacle 13 has a shape which in plan corresponds to that of the aperture 12. The supporting bed-pan X, or a commode, will of course have a cavity shaped to receive the receptacle 13 and a seat part which will accommodate the recesses and depressions 14 and 15.

I claim:

1. A disposable one-piece insert for a bed-pan or commode, comprising a receptacle portion having a small downward taper, a seat portion extending from said receptacle portion and having a front part which is higher than the rear part thereof, an aperture in said seat portion providing an opening into said receptacle portion, said aperture and receptacle portion being elongated from front to rear and waisted between their ends, said seat portion having a downturned peripheral lip and being provided at each side of its receptacle portion towards its rear with a concavity and at the rear of the receptacle portion with a depression which merger smoothly into said rearward side concavities.

* * * * *